US011213092B2

(12) United States Patent
Elliott

(10) Patent No.: US 11,213,092 B2
(45) Date of Patent: Jan. 4, 2022

(54) RETROFIT PLANTAR NERVE PROTECTING SHOE SOLE

(71) Applicant: Tammy Elliott, Atlanta, GA (US)

(72) Inventor: Tammy Elliott, Atlanta, GA (US)

( * ) Notice: Subject to any disclaimer, the term of this patent is extended or adjusted under 35 U.S.C. 154(b) by 35 days.

(21) Appl. No.: 16/404,778

(22) Filed: May 7, 2019

(65) Prior Publication Data

US 2020/0154821 A1 May 21, 2020

Related U.S. Application Data

(63) Continuation-in-part of application No. 62/768,201, filed on Nov. 16, 2018.

(51) Int. Cl.

| | |
|---|---|
| ***A43B 13/18*** | (2006.01) |
| ***A43B 13/37*** | (2006.01) |
| *A43B 13/28* | (2006.01) |

(52) U.S. Cl.

CPC ..... *A43B 13/18* (2013.01); *A43B 13/37* (2013.01); *A43B 13/28* (2013.01)

(58) Field of Classification Search

None

See application file for complete search history.

(56) References Cited

U.S. PATENT DOCUMENTS 1,350,839 A * 8/1920 Edgcumbe ..... A43B 13/24 36/59 B
1,524,997 A * 2/1925 Smith ..... A43B 13/24 36/59 B
2,128,134 A * 8/1938 Giusto ..... A43C 15/00 36/7.5
2,159,054 A * 5/1939 Silver ..... A43B 7/14 36/145
2,288,199 A * 6/1942 Levy ..... A43B 23/28 36/10
2,411,901 A * 12/1946 Silver ..... A43B 7/1415 36/145
2,732,065 A * 1/1956 Marchese ..... A43C 15/02 206/390
2,844,833 A * 7/1958 Odermatt ..... A43B 13/12 12/146 B
3,027,661 A * 4/1962 McCord ..... A43B 1/0081 36/30 R
3,672,077 A * 6/1972 Coles ..... A43B 13/26 36/134
4,852,273 A * 8/1989 Hamy ..... A43B 7/141 36/28
5,430,960 A * 7/1995 Richardson ..... A43B 7/14 36/114

(Continued)

*Primary Examiner* — Jila M Mohandesi
(74) *Attorney, Agent, or Firm* — H. Brock Kolls

(57) ABSTRACT

The present invention relates to a retrofit plantar nerve protecting shoe sole for minimizing Solus Neuralgia or SNA, intense nerve pain in the sole of the foot, induced by high heel, rigid, or thin sole shoes by abating trauma causing repetitive wave energy, generated by walking, from impacting certain of the plantar nerves located between the arch of foot and toes. The sole is a pliable material having relief cutouts. Alignment indicia aids in orientating the sole with a foot in a shoe so that the relief cutouts are substantially positioned around and below the projected location of plantar nerves. An adhesive holds the sole in place on the outsole of the shoe. Optional toe-bridges lift toes to further abate nerve injury.

20 Claims, 5 Drawing Sheets

(56) References Cited

U.S. PATENT DOCUMENTS

| | | | | |
|---|---|---|---|---|
| 5,438,768 | A * | 8/1995 | Bauerfeind | A43B 7/1425 36/165 |
| 5,768,803 | A * | 6/1998 | Levy | A43B 7/1425 36/140 |
| 6,327,795 | B1 * | 12/2001 | Russell | A43B 13/145 36/27 |
| 6,571,491 | B2 * | 6/2003 | Safdeye | A43B 13/12 12/142 G |
| 9,615,630 | B2 * | 4/2017 | Jackson | A43B 13/145 |
| 2005/0240139 | A1 * | 10/2005 | Bushby | A43B 7/145 602/61 |
| 2006/0053660 | A1 * | 3/2006 | Lewton | A43B 13/36 36/59 R |
| 2008/0282577 | A1 * | 11/2008 | Holeyfield | A43C 15/04 36/7.1 R |
| 2011/0126427 | A1 * | 6/2011 | Richie, Jr. | A43B 7/1485 36/91 |
| 2012/0096745 | A1 * | 4/2012 | Donato | A43B 7/147 36/174 |
| 2016/0037858 | A1 * | 2/2016 | Foxen | A43B 13/14 36/103 |
| 2016/0044990 | A1 * | 2/2016 | Georgeson | A43B 17/14 36/43 |
| 2016/0316854 | A1 * | 11/2016 | Young | A43B 7/1425 |
| 2018/0116338 | A1 * | 5/2018 | Glaze | A43B 13/36 |
| 2020/0037707 | A1 * | 2/2020 | Anderson | A43B 3/18 |
| 2020/0121029 | A1 * | 4/2020 | Hayashi | A43B 23/28 |

* cited by examiner

RETROFIT PLANTAR NERVE PROTECTING SHOE SOLE

CROSS-REFERENCE TO RELATED APPLICATIONS

This application contains subject matter which is related to the subject matter of the following application. The below-listed application is hereby incorporated herein by reference in its entirety:

This is a U.S. non-provisional application that is a continuation-in-part of a U.S. provisional application, Ser. No. 62/768,201, inventor Tammy Elliott, entitled "Platform to apply to high heel footwear (stilettos, pumps, boots)", filed Nov. 16, 2018.

TECHNICAL FIELD OF THE INVENTION

This invention relates to a retrofit plantar nerve protecting shoe sole and method for minimizing foot pain from high heel, rigid, or thin sole shoes by abating trauma causing repetitive wave energy, generated by walking, from impacting certain of the plantar nerves located between the arch of foot and toes.

BACKGROUND OF THE INVENTION

Before our invention it was common for people wearing high heel shoes to expect their feet to hurt rather quickly. In operation, the elevating of the heel transfers additional weight to the ball of the foot and the constricting nature of the shoe coupled with the rigid or thin sole makes ripe the conditions to transfer repetitive impact energy with each step into the foot causing it to hurt.

This medical condition is commonly referred to as Metatarsalgia, a general term used to denote a painful foot condition in the metatarsal region of the foot (the area just before the toes, more commonly referred to as the ball-of-the-foot).

Aftermarket insoles make claims of comfort to the foot but in tight-fitting shoes, the addition of another insole only makes the shoes more constricting which cause the foot to hurt.

In addition, aftermarket insoles treat the foot as a uniform surface and as such provide an insole that supports across the entire bottom of the foot. Doing so neglects contemplation of how the foot is injured into hurting in the first place. In this regard, uniform surface insole approaches, do not seek to isolate the sensitive nerves of the foot and abate the injurious repetitive forces generated when walking in high heel shoes which cause them to hurt.

The present invention addresses these and other shortcomings by providing a retrofit plantar nerve protecting shoe sole and method of installation and use. For these reasons and shortcomings as well as other reasons and shortcomings there is a long felt need that gives rise to the present invention.

SUMMARY OF THE INVENTION

The shortcomings of the prior art are overcome and additional advantages are provided through the provision of a retrofit plantar nerve protecting shoe sole for minimizing foot pain from high heel, rigid, or thin sole shoes by abating trauma causing repetitive wave energy, generated by walking, from impacting certain of the plantar nerves located between arch of foot and toes.

The retrofit plantar nerve protecting shoe sole comprising at least one of a pliable material having an outer circumference edge and at least one of a relief cutout, the relief cutout is either a recess or hole in a portion of the pliable material. The retrofit plantar nerve protecting shoe sole further comprises at least one of an alignment indicia. The relief cutout is positioned within the pliable material with reference to the alignment indicia and at least one of an adhesive layer operationally related to the pliable material.

The pliable material by way of the alignment indicia is orientated in accordance with the position of a foot in a shoe. The shoe further comprising an outsole, the pliable material is affixed to the outsole by way of the adhesive layer in a manner that preserves the orientation between the alignment indicia and the foot in the shoe so that the relief cutout is substantially positioned around and below the projected location of at least one of a plantar nerve associated with the foot. The pliable material having a thickness proximate the circumference edge which elevates the outsole when walking, creating a gap within the relief cutout between the outsole and ground, holding a portion of the outsole within the relief cutout from touching ground which minimizes introduction into the outsole of trauma causing repetitive wave energy, and abating adverse impact on the plantar nerve minimizing foot pain.

Additional shortcomings of the prior art are overcome and additional advantages are provided through the provision of a retrofit plantar nerve protecting shoe sole for minimizing foot pain from high heel, rigid, or thin sole shoes by abating trauma causing repetitive wave energy, generated by walking, from impacting certain of the plantar nerves located between arch of foot and toes.

The retrofit plantar nerve protecting shoe sole comprising at least one of a pliable material having an outer circumference edge and more than one of a relief cutout, each of the relief cutout is cut but remains connected in place optionally removable prior to installation. At least one of an alignment indicia, the relief cutout is positioned within the pliable material with reference to the alignment indicia and at least one of an adhesive layer operationally related to the pliable material, the pliable material by way of the alignment indicia is orientated in accordance with position of a foot in a shoe, the shoe further comprising an insole and an outsole. The pliable material is affixed to the outsole by way of the adhesive layer in a manner that preserves the orientation between the alignment indicia and the foot in the shoe so that each of the relief cutouts is substantially positioned around and below the projected location of at least one of a plantar nerve associated with the foot. The pliable material having a thickness proximate the circumference edge which elevates the outsole when walking, creating a gap within each of the relief cutout between the outsole and ground, holding portion of the outsole within each of the relief cutout from touching ground, which minimizes introduction into the outsole of trauma causing repetitive wave energy, and abating adverse impact on the plantar nerve minimizing foot pain.

Additional shortcomings of the prior art are overcome and additional advantages are provided through the provision of a method of minimizing foot pain from high heel, rigid, or thin sole shoes by abating trauma causing repetitive wave energy, generated by walking, from impacting certain of the plantar nerves located between the arch of foot and toes.

The method comprising the steps of forming a retrofit plantar nerve protecting shoe sole from at least one of a pliable material, the pliable material having an outer circumference edge and at least one of a relief cutout, the retrofit plantar nerve protecting shoe sole further comprising at least one of an alignment indicia, and at least one of an adhesive layer, each of the relief cutout is cut and selectively removable creating either a recess or hole in portion of the retrofit plantar nerve protecting shoe sole, each of the relief cutouts is positioned within the pliable material with reference to the alignment indicia.

The method continues by orientating, by way of the alignment indicia, the retrofit plantar nerve protecting shoe sole with position of a foot in a shoe, the shoe further comprising an outsole and adhering, by way of the adhesive layer, the retrofit plantar nerve protecting shoe sole to the outsole of the shoe in a manner that preserves the orientation between the alignment indicia and the foot in the shoe so that the relief cutout is substantially positioned around and below projected location of at least one of a plantar nerve. The pliable material having a thickness proximate the circumference edge which elevates the outsole when walking in the shoe, creating a gap within the relief cutout between the outsole and ground, holding portion of the outsole within the relief cutout from touching ground which minimizes introduction into the outsole of trauma causing repetitive wave energy, and abating adverse impact on the plantar nerve minimizing foot pain.

Systems, manufacturing, and computer program products corresponding to the above-summarized methods are also described and claimed herein.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1A:
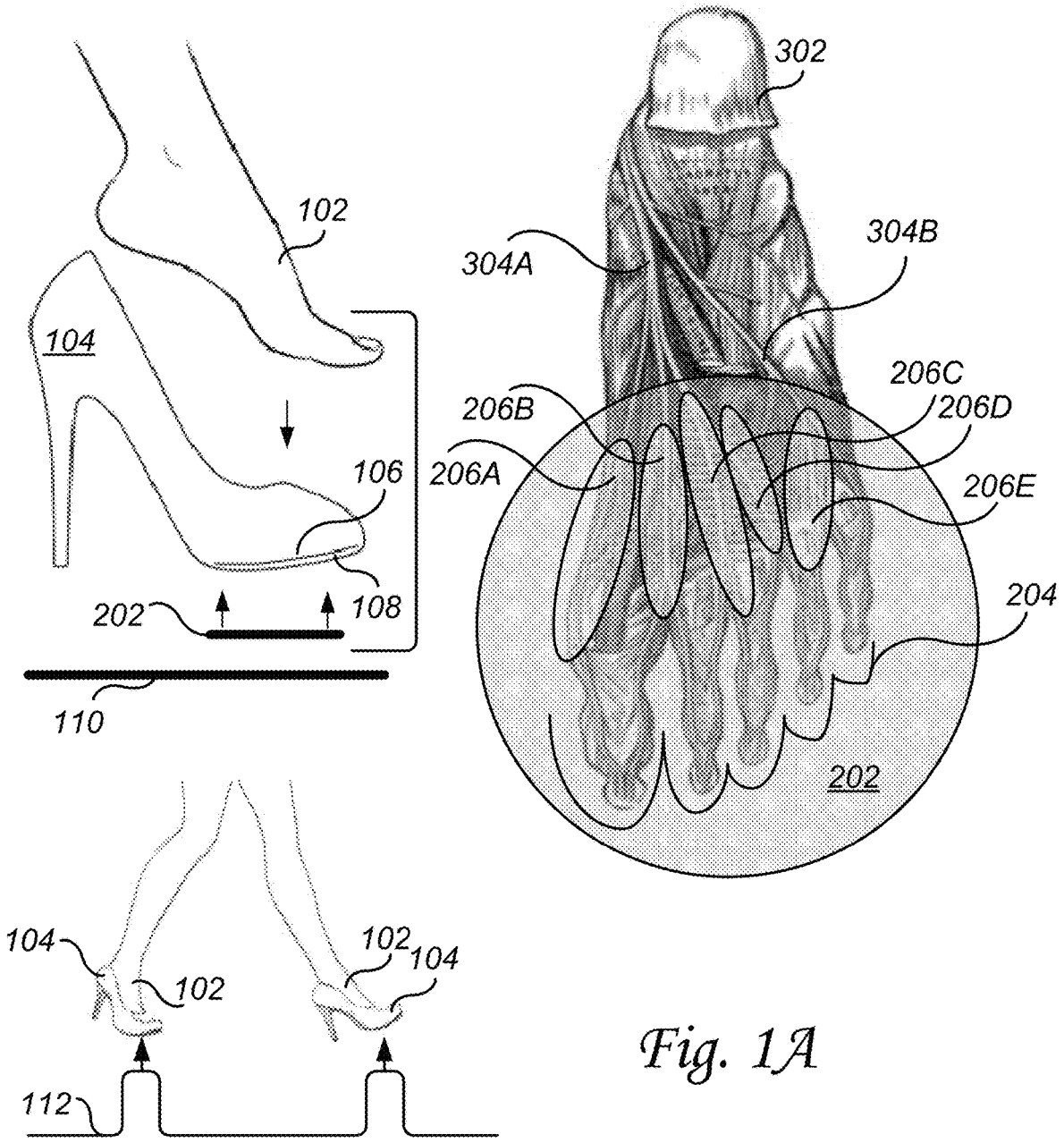
FIGS. 1A and 1B illustrate examples of a retrofit plantar nerve protecting shoe sole for minimizing foot pain.
Figure 1B:
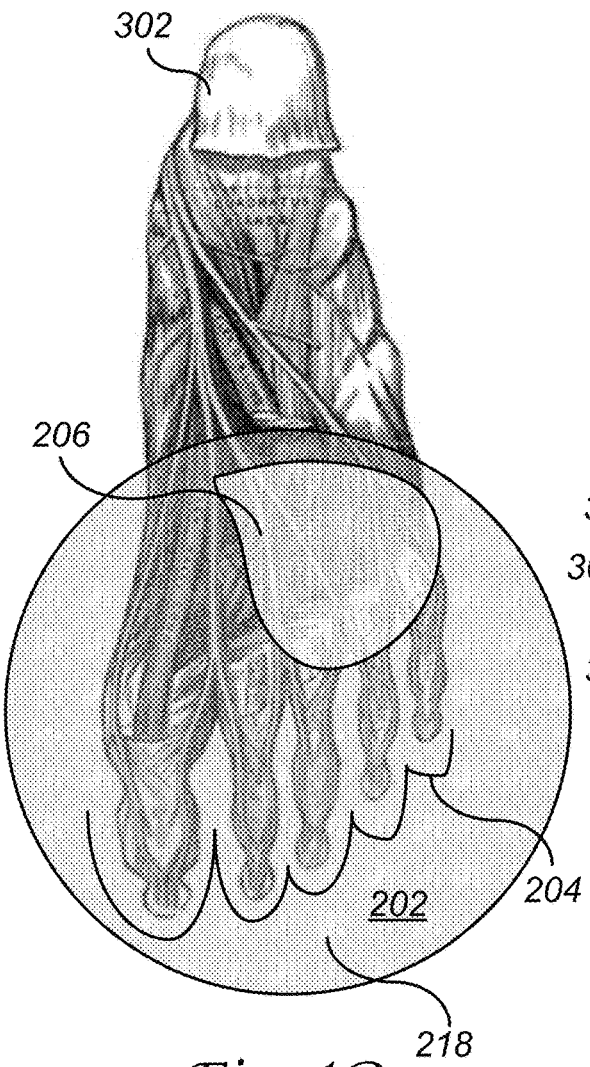

Turning now to the drawings in greater detail, it will be seen that in FIGS. 1A and 1B there is illustrated examples of a retrofit plantar nerve protecting shoe sole 202 for minimizing foot 102 pain. In an exemplary embodiment, a foot 102 is placed in a shoe 104. The shoe 104 selectively having an insole 106 and an outsole 108. Though fashionable, it is notoriously known that when wearing and walking in shoes 104 having a high heel, rigid, or thin sole as illustrated can result in foot 102 pain rather quickly.

In the present invention "rigid or thin sole" is intended to mean a shoe sole that is either formed with a hard material such as wood, plastic, or other similar material which easily conducts wave energy 112 to the foot when walking or such a thin sole like leather or other similar material that the forces and wave energy 112 of the hard rigid ground surface are transferred to the foot with little cushion or shock abatement. The thin sole can make it feel like the sole of the shoe is as hard as the rigid ground being walked.

As the height of the shoe heel increases so does the amount of weight transferred to the ball or front portion of the foot 102. This increasing weight also increases the pressure on the plantar nerves. Such plantar nerves 304A-304F illustrated in at least FIG. 2 run along the bottom of the foot 102. Many of the plantar nerves are located between the arch 308 and toes 306A-306F. With the foot 102 constricted in shoe 104 and a sole comprising an insole 106 and outsole 108 between the foot 102 and the ground 110, the plantar nerves 304A-304F can be subjected to injurious repetitive wave energy 112 impacts each time the outsole 108 contacts the ground 110, generated by walking, causing foot 102 pain. The repetitive plantar nerve injuring wave energy 112 can cause a condition known as Solus Neuralgia or SNA, intense nerve pain in the sole of the foot, typically located between the arch of foot and toes, induced by high heel, rigid, or thin sole shoes.

Figure 5A:
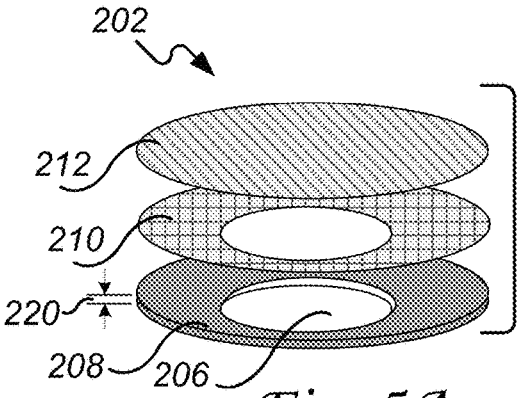
FIGS. 5A and 5B illustrate examples of the fabrication of a retrofit plantar nerve protecting shoe sole for minimizing foot pain.
Figure 5B:
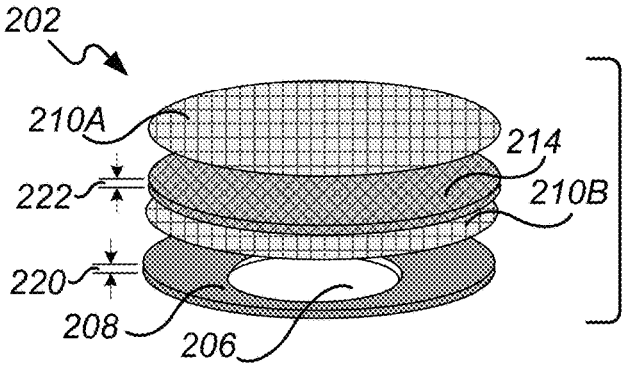

In an exemplary embodiment, the present invention seeks to remedy SNA by providing a retrofit plantar nerve protecting shoe sole 202 which is applied to the outsole 108 of the shoe 104. In this regard, at least one of a pliable material 208 has an outer circumference edge 218 and at least one of a relief cutout 206A-206E. The relief cutouts are either a recess or hole in a portion of the pliable material 208. There is at least one alignment indicia 204 to aid in positioning the retrofit plantar nerve protecting shoe sole 202. The relief cutout 206A-206E is positioned within the pliable material 208 with reference to the alignment indicia 204. At least one of an adhesive layer 212, as illustrated in at least FIGS. 5A and 5B, is operationally related to the pliable material 208. The pliable material 208, by way of the alignment indicia 204, is orientated in accordance with the position of the foot 102 in the shoe 104. The pliable material 208 is affixed to the outsole 108 by way of the adhesive layer 210 in a manner that preserves the orientation between the alignment indicia 204 and the foot 102 in the shoe 104 so that the relief cutout 206A-206E is substantially positioned around and below projected location of plantar nerves 304A-304F associated with the foot 102. The pliable material 208 having a thickness 220 proximate the circumference edge 218 which elevates the outsole 108 when walking. This creates a gap within the relief cutouts 206A-206E between the outsole 108 and the ground 110, holding a portion of the outsole 108 within the relief cutouts 206A-206E, from touching ground 202, preventing introduction into the outsole 108 of trauma causing repetitive wave energy 112, and abating adverse impact on the plantar nerve 304A-304F thus minimizing foot pain.

Also illustrate in FIG. 1A, is a bottom view of foot anatomy 302 of foot 102. Illustrated are the locations of plantar nerves 304A and 304B. The plantar nerves are better illustrated in at least FIG. 2 as plantar nerves 304A-304F.

In the present invention, the term "ground" is intended to mean the surface being walked on.

In an exemplary embodiment, for example, and not a limitation, more than one relief cutout can be cut but remain connected in place being optionally removable prior to installation. In this regard, relief cutouts 206A-206E can be located with reference to the alignment indicia 204 under different plantar nerves of the foot 102. Illustrated in FIG. 1A is the retrofit plantar nerve protecting shoe sole 202 superimposed over a bottom of foot anatomy 302 to show them how the location of the relief cutouts 206A-206E are located in reference to alignment indicia 204 so that each of the relief cutout 206A-206E is projected to be located under at least one of a plantar nerve 304A-304F (as numbered in at least FIG. 2).

In operation, when a consumer is ready to affix the retrofit plantar nerve protecting shoe sole 202 to their shoe 104 they can insert their foot 102 into shoe 104. The consumer can then use the alignment indicia 204 to orientate the retrofit plantar nerve protecting shoe sole 202 with respect to the foot 102 in the shoe. The consumer can remove the relief cutouts in areas they experience foot pain thus protecting the plantar nerves in the affect areas. Once removed, the retrofit plantar nerve protecting shoe sole 202 can be adhered in place on the outsole 108.

Figure 3A:
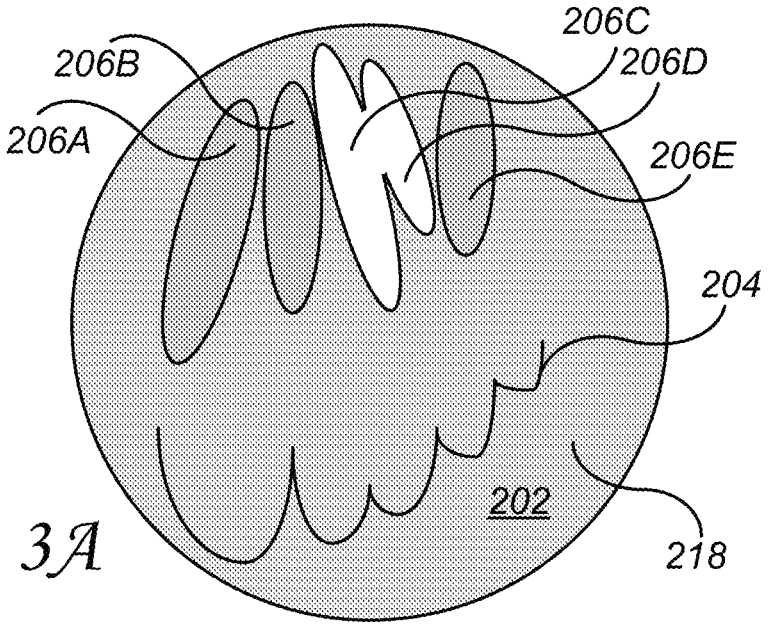
FIGS. 3A, 3B, and 3C illustrate examples of a retrofit plantar nerve protecting shoe sole for minimizing foot pain.

For example and not a limitation, in an exemplary embodiment, in at least FIG. 3A it is illustrated how certain of the relief cutouts such as 206C and 206D can be removed to protect the plantar nerves associated with middle toe 306C and ring toe 306D. In this exemplary embodiment, relief cutouts 206A, 206B, and 206E, though cut, are not removed and thus aid to lift the outsole 108 from touching the ground 110 within the removed relief cutout areas 206C and 206D. In this regard, plantar nerves 306C and 306D are protected from receiving injurious repetitive wave energy 112 impacts generated when walking thus minimizing foot pain. In other embodiments, different cutouts can be removed to protect other plantar nerves as may be required and/or desired.

Now when the consumer wears and walks in the shoes the retrofit plantar nerve protecting shoe sole 202 elevates the outsole 106 and creates a gap, within the removed relief cutout 206 area, between the outsole 106 and the ground 110 which prevents repetitive trauma conductance of injurious wave energy 112 generated when the outsole 108 strikes the ground 110 under load from reaching certain of the sensitive plantar nerves 304A-304F thus minimizing foot pain.

Referring to FIG. 1B there is illustrated a retrofit plantar nerve protecting shoe sole 202 superimposed over the projected location of plantar nerves in foot anatomy 302. In an exemplary embodiment, a retrofit plantar nerve protecting shoe sole 202 reduces foot pain from high heel, rigid, and thin sole 106 and 108 shoes 104 by abating trauma causing repetitive wave energy 112, generated by walking, when the outsole 108 strikes the ground 110 under load from impacting at least some of the plantar nerves 304A-304F located between arch 308 of foot and toes 306A-306F.

The retrofit plantar nerve protecting shoe sole comprising at least one of a pliable material having an outer circumference edge 218 and at least one of a relief cutout 206, the relief cutout 206 is either a recess or hole in a portion of the pliable material 208.

The retrofit plantar nerve protecting shoe sole 202 having at least one alignment indicia 204 to aid in aligning retrofit plantar nerve protecting shoe sole 202 with the foot 102 in the shoe 104. In an exemplary embodiment, at least a portion of the outer circumference edge 218 can be contoured into a profile of toes to create the alignment indicia 204 as illustrates in at least FIG. 3C.

Figure 3B:
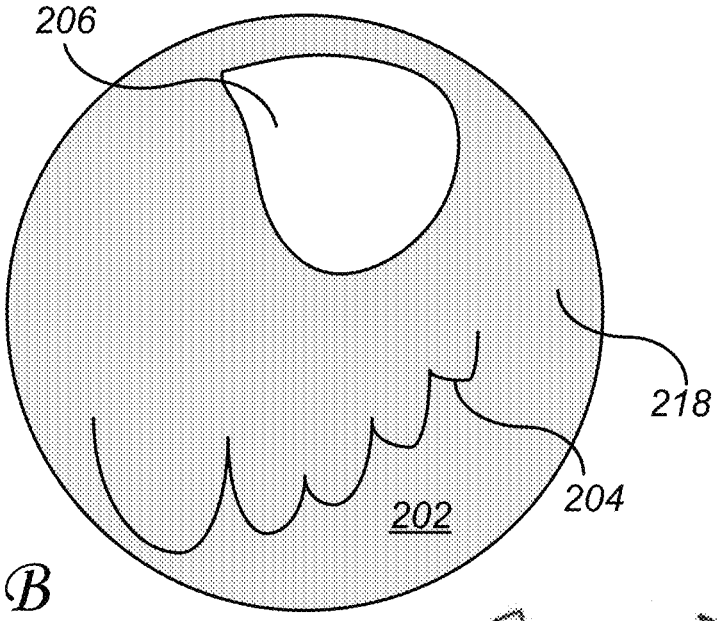

In other exemplary embodiments, the alignment indicia 204 can be molded or imprinted on the retrofit plantar nerve protecting shoe sole 202 as a toe profile as better illustrated in at least FIGS. 1A, 3A, and 3B, as a mold or an imprint of other shapes, arrows, lines, text, or other indicia, imprinted on a disposable liner 212 as illustrated in at least FIG. 5A, or by other alignment indicia as may be required and/or required in a particular embodiment.

The relief cutout 206 is positioned within the pliable material 208 with reference to the alignment indicia 204. This creates a relationship wherein when the alignment indicia 204 is aligned with the foot 102 in the shoe 104 the relief cutout 206 is properly located around and below the projected location of the plantar nerve of interest.

At least one of an adhesive layer 212 is operationally related to the pliable material 208. In operation, the pliable material 208 by way of the alignment indicia 204 is orientated in accordance with the position of the foot 102 in the shoe 104. The pliable material 208 is then affixed to the outsole 108 by way of the adhesive layer 212 in a manner that preserves the orientation between the alignment indicia 204 and the foot 102 in the shoe 104 so that the relief cutout 206 is substantially positioned around and below projected location of at least one of a plantar nerve of interest associated with the foot 102.

The pliable material having a thickness 220 proximate the circumference edge 218 which elevates the outsole 108 when walking, creating a gap, within the relief cutout 206 between the outsole 108 and ground 110 holding a portion of the outsole 108 within the relief cutout 206 from touching the ground 110 preventing introduction into the outsole 108 of trauma causing repetitive wave energy 112, abating adverse impact on the plantar nerve minimizing foot 102 pain.

Figure 2:
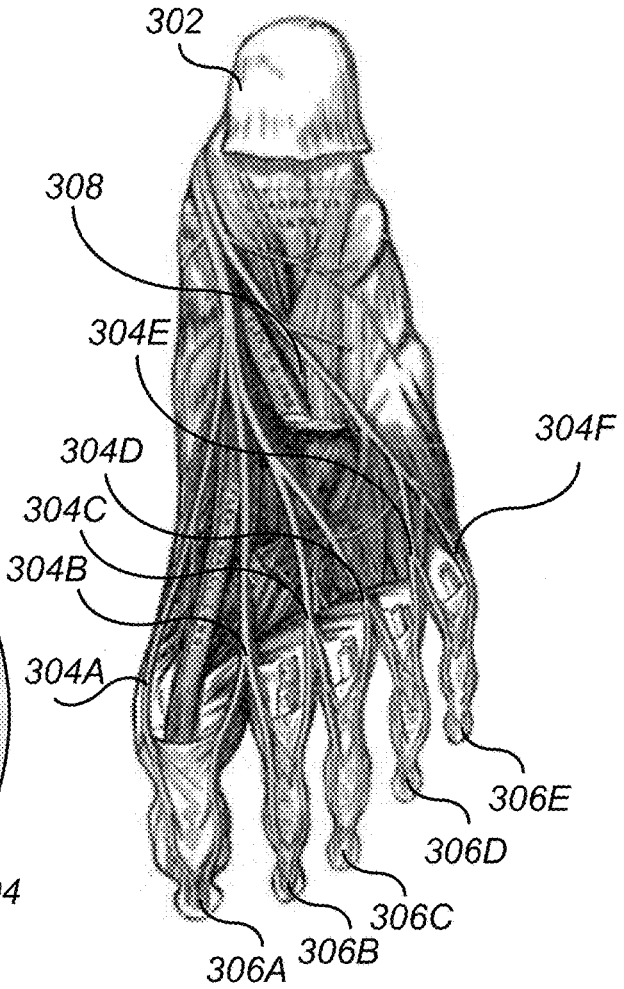
FIG. 2 illustrates one example of the bottom of the foot anatomy showing planar nerves and toes.

Referring to FIG. 2 there is illustrated one example of the bottom of the foot anatomy 302 showing planar nerves 304A-304F and toes 306A-306F. In this regard, big toe 306A has associated therewith planar nerves 304A and 304B. Long toe 306B has associated therewith planar nerves 304B and 304C. Middle toe 306C has associated therewith planar nerves 306C and 306D. Ring toe 306D has associated therewith planar nerves 304D and 304E and pinky toe 306E has associated therewith planar nerve 306E and 306F. Also illustrated, the arch 308 roughly centrally located along the bottom of the foot.

Figure 3C:
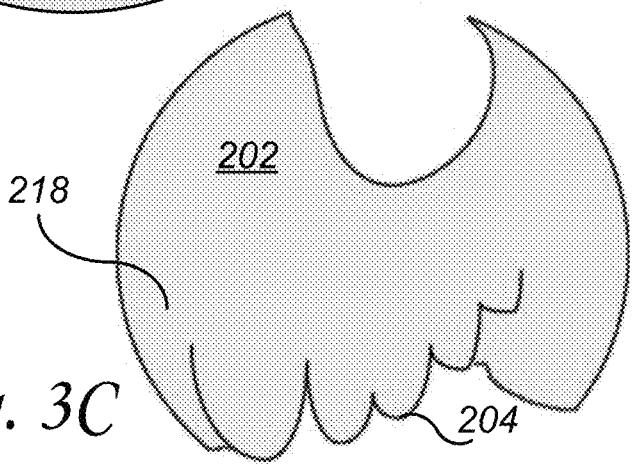

Referring to FIGS. 3A, 3B, and 3C there is illustrated examples of a retrofit plantar nerve protecting shoe sole 202 for minimizing foot 102 pain. FIG. 3A, in an exemplary embodiment, has several relief cutouts that can be removed as needed to protect specific plantar nerves. In this regard, as an example and not a limitation, relief cutouts 206C and 206D can be removed to protect correspondingly plantar nerves 304C and 304D. Additionally, relief cutouts 206A, 206B, and 206E can be cut but not removed. In this manner, the plantar nerve protecting shoe sole 202 can be customized by a consumer to aid in protecting the plantar nerves that bother them the most by removing the corresponding relief cutouts at the time when the plantar nerve protecting shoe sole 202 is installed onto the shoe 104.

With reference to FIG. 3B, there is illustrated a single relief cutout 206. Relief cutout 206 encompasses multiple planar nerves. In an exemplary embodiment, for example, and not a limitation, a planar nerve cluster which runs between the arch 308 and the middle toe 306C and ring toe 306D can both be protected. In research testing, this location the planar nerves associated with toes 306C and 306D seem particularly sensitive to repetitive wave energy 112 trauma, generated by walking, when the outsole 108 impacts the ground 110 under body weight load. Correspondingly, the plantar nerve protecting shoe sole 202 of this configuration has demonstrated significant pain reduction and relief.

Referring to FIG. 3C, in an exemplary embodiment, at least a portion of the outer circumference edge 218 can be contoured into a profile of toes to create the alignment indicia 204. In this regard, it is easy for the consumer to align and position the plantar nerve protecting shoe sole 202 on the shoe 104 outsole 108 by matching the profile of toes with their foot 102 when it is in shoe 140.

Each of FIGS. 3A, 3B, and 3C illustrated alignment indicia 204. Such can be a molding, marking, or other indicia to aid in aligning the plantar nerve protecting shoe sole 202 with the foot 102 in the shoe 104. In other exemplary embodiments, other indicia patterns, markings, text, and other indicia can be used as alignment indicia 204 as may be required and/or desired in a particular embodiment.

Figure 4:
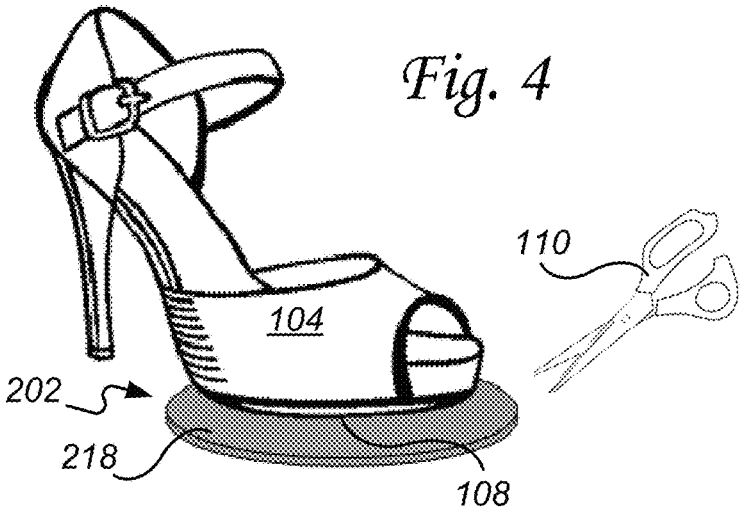
FIG. 4 illustrates one example of applying a retrofit plantar nerve protecting shoe sole onto a shoe.

Referring to FIG. 4 there is illustrated one example of applying a retrofit plantar nerve protecting shoe sole 202 onto a shoe. In an exemplary embodiment, the retrofit plantar nerve protecting shoe sole 202 is adhered by an adhesive layer 212 to the outsole of show 104. In cases that the retrofit plantar nerve protecting shoe sole 202 extends beyond the outsole 108 the outer circumference edge 218 can be trimmed to the peripheral edge of the outsole 108 using scissors 110 or other cutting methods.

In an exemplary embodiment, the plantar nerve protecting shoe sole 202 can be removed when worn out or damaged from outsole 108 by peeling it off and replacing it with a new plantar nerve protecting shoe sole 202.

Referring to FIGS. 5A and 5B there is illustrated examples of the fabrication of a retrofit plantar nerve protecting shoe sole 202 for minimizing foot 102 pains. With respect to FIG. 5A, at least one of a pliable material 208 having an outer circumference edge 218 and at least one of a relief cutout 206, the relief cutout 206 is either a recess or hole in a portion of the pliable material 208. The pliable material 208 having a thickness 220 of typically a couple of millimeters, generally a thickness selected that compensates for reasonable wear while providing sufficient thickness to keep the outsole 108, within an exposed relief cutout 206, off the ground 110 so that injurious energy 112 is not induced into the outer sole 108 when walking. Such pliable material 208 can be a shock absorbing material like BUTYL RUBBER, NEOPRENE, SORBOTHANE, or other types and/or kinds of pliable material as may be required and/or desired in a particular embodiment. In an exemplary embodiment, at least portion of the pliable material is SORBOTHANE.

An adhesive layer 210 can be applied to the pliable material 208 and protected prior to application by a disposable liner 212. Either of the pliable material 208, adhesive layer 210 or disposable liner 212 can have alignment indicia thereon as may be required and/or desired in a particular embodiment. The pliable material 208, adhesive layer 210, and disposable liner 212 can be pressed together to form the retrofit plantar nerve protecting shoe sole 202. Such an adhesive layer can be a 3M brand, COMMAND STRIPS, SHOE GLUE, or other types and/or kinds of adhesive as may be required and/or desired in a particular embodiment. In operation, the disposable liner 212 can be removed exposing the adhesive surface effectuating the ability to adhere to the retrofit plantar nerve protecting shoe sole 202 to the outsole 118 of shoe 104.

In an exemplary embodiment, preferably though not a limitation, the adhesive layer 210 can be applied as a thin film onto the pliable material 208 and covered with disposable liner 212 so that a consumer can easily remove disposable liner 212 and adhere the pliable material 208 onto shoe 104 outsole 108 easily.

For purposes of disclosure, in a plurality of other exemplary embodiments, other layers of materials might be applied between the pliable material 208 and the adhesive layer 210. Furthermore, there may be multiple layers of materials that each requires an adhesive layer to adhere to the multiple layers of materials together. In general, however, and in the spirit and scope of the present invention, the pliable material 208 and other layers assembled together can be adhered to the outsole 108 by way of an adhesive regardless of the layering of materials and need for additional layers of adhesive between the material layers to achieve the endpoint.

With reference to FIG. 5B, a layer of sound damping material 214 can be positioned between the adhesive layer 210A and 210B, and the pliable material 208. In this regard, the sound damping material is effective in damping the injurious energy impact on the planar nerves from the repetitive wave energy 112, generated by walking, further minimizing foot 102 pain. The sound damping material 214 having a thickness 222, typically in the range of a couple millimeters, is select to suitability dampen the wave energy 112 while maintaining the durability of the retrofit plantar nerve protecting shoe sole 202.

For disclosure purpose sound damping material 214 can also be damping tape, sound deadening pads, sound damping foams, and other materials which collectively will be referred to as sound damping material. In an exemplary embodiment, for example, and not a limitation, such foams and tape can be 3M brand 434 or similar vibration damping, QUIET BARRIER brand tape, 3M brand sound deadening pad such as #08840 or similar, or other types and kinds of sound damping material as may be required and/or desired in a particular embodiment.

Figure 6:
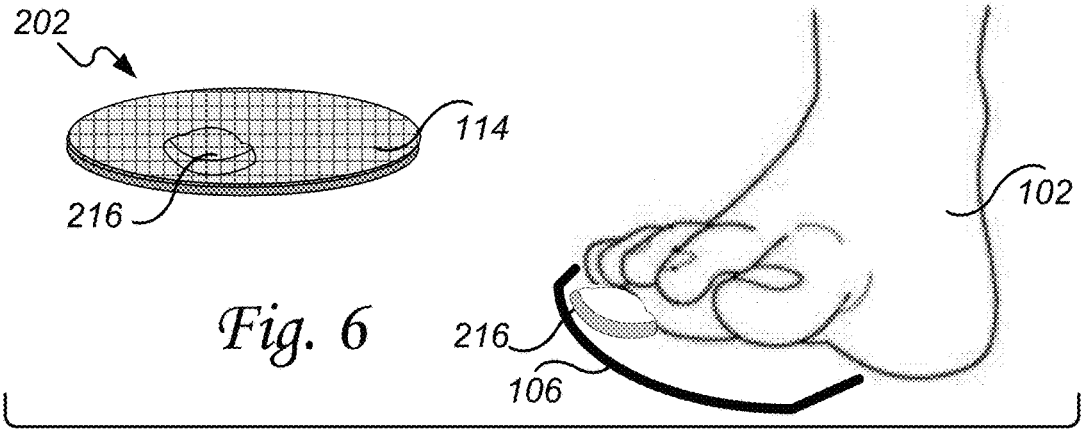
FIG. 6 illustrates one example of a toe-bridge.

Referring to FIG. 6, there is illustrated one example of a toe-bridge 216. In an exemplary embodiment, at least one of a toe-bridge 216 can be formed and detachable from a portion of the pliable material 208, formed and detachable from a fully assembled retrofit plantar nerve protecting shoe sole 202, or provided as a separate assembly packaged with the plantar nerve protecting shoe sole 202. In addition, the toe-bridge 216 can be repurposed removed relief cutouts. In this regard, when a relief cutout is selectively removed from the retrofit plantar nerve protecting shoe sole 202, the removed portion can be used as a toe-bridge 216.

The toe-bridge 216 can be positioned under certain of the toes of foot 102 raising the plantar nerves associated with the raised toes up slightly off of the insole 106 to lessen the injurious impact on the plantar nerves from the repetitive wave energy 112, generated when the shoe makes contact with the ground, such as when walking.

As an example and not a limitation, in an exemplary embodiment, the middle toe 306C and ring toe 306D of foot 102 being highly susceptible to plantar nerve injury can be raised slightly above the insole 106 by placing the toe-bridge 216 under the toes 306C and 306D. The toe-bridge 216 can be adhered to the insole by way of the adhesive layer 210. In other exemplary embodiments, toe-bridges 216 can be placed under other toes as may be required and/or desired in a particular embodiment.

Additionally, as desired toe-bridges 216 can be used to raise toes which correspond to the relief cutouts being removed to gain an additional benefit in minimizing injurious energy from impacting sensitive planar nerves. In this regard, big toe 204A can be raised when relief cutout 206A is removed and long toe 306B can be raised when relief cutout 206B is removed and so on across all the toes and toe combination as desired. Alternatively, toe-bridges 216 can be used under toes whenever the consumer receives a foot comfort benefit regardless of the inclusion or exclusion of the corresponding relief cutout.

Figure 7:
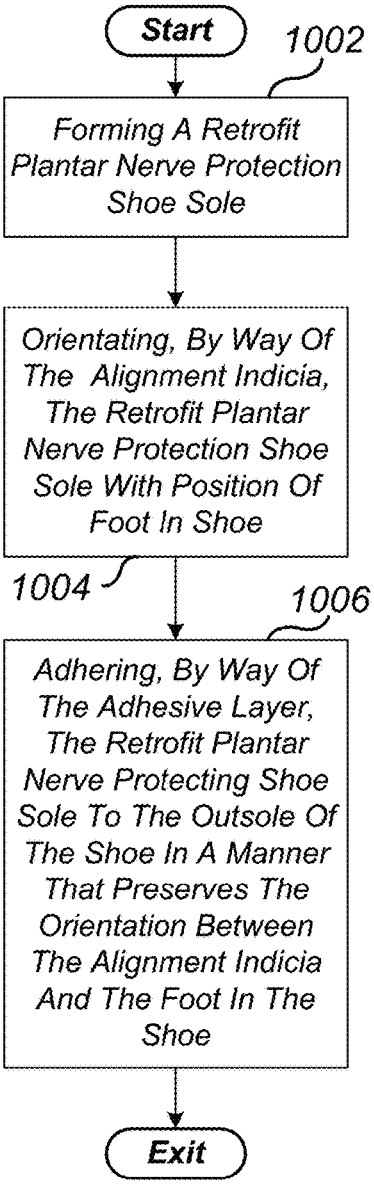
FIG. 7 illustrates one example of a method of minimizing foot pain from high heel, rigid, or thin sole shoes by abating trauma causing repetitive wave energy, generated by walking, from impacting certain of the plantar nerves located between the arch of foot and toes.

Referring to FIG. 7 there is illustrated one example of a method of minimizing foot 102 pain from high heel, rigid, or thin sole shoes 104 by abating trauma causing repetitive wave energy 112, generated by walking, from impacting certain of the plantar nerves 304A-304F located between arch 308 of foot 102 and toes 306A-306C. In an exemplary, the method begins in block 1002.

In block 1002 a retrofit plantar nerve protecting shoe sole 202 is formed from at least one of a pliable material 208, the pliable material 208 having an outer circumference edge 218 and at least one of a relief cutout 206, the retrofit plantar nerve protecting shoe 202 sole further comprising at least one of an alignment indicia 204, and at least one of an adhesive layer 210, each of the relief cutout 206 is positioned within the pliable material 208 with reference to the alignment indicia 204. The method moves to block 1004.

In block 1004, by way of the alignment indicia 204, the retrofit plantar nerve protecting shoe sole 202 is orientated with the position of a foot 102 in a shoe 104, the shoe 104 further comprising an outsole 108. The method moves to block 1006.

In block 1006, by way of the adhesive layer 210, the retrofit plantar nerve protecting shoe sole 202 is adhered to the outsole 108 of the shoe 104 in a manner that preserves the orientation between the alignment indicia 204 and the foot 102 in the shoe 104 so that the relief cutout 206 is substantially positioned around and below projected location of the plantar nerve 304, the pliable material 208 having a thickness 220 proximate the circumference edge 218 which elevates the outsole 108 when walking in the shoe 104, creating a gap within the relief cutout 206 between the outsole 108 and ground 110, holding portion of the outsole 108 within the relief cutout 206 from touching ground 110 preventing introduction into the outsole 108 of trauma causing repetitive wave energy 112, abating adverse impact on the plantar nerve 304 minimizing foot 102 pain. The method is then exited.

Figure 8:
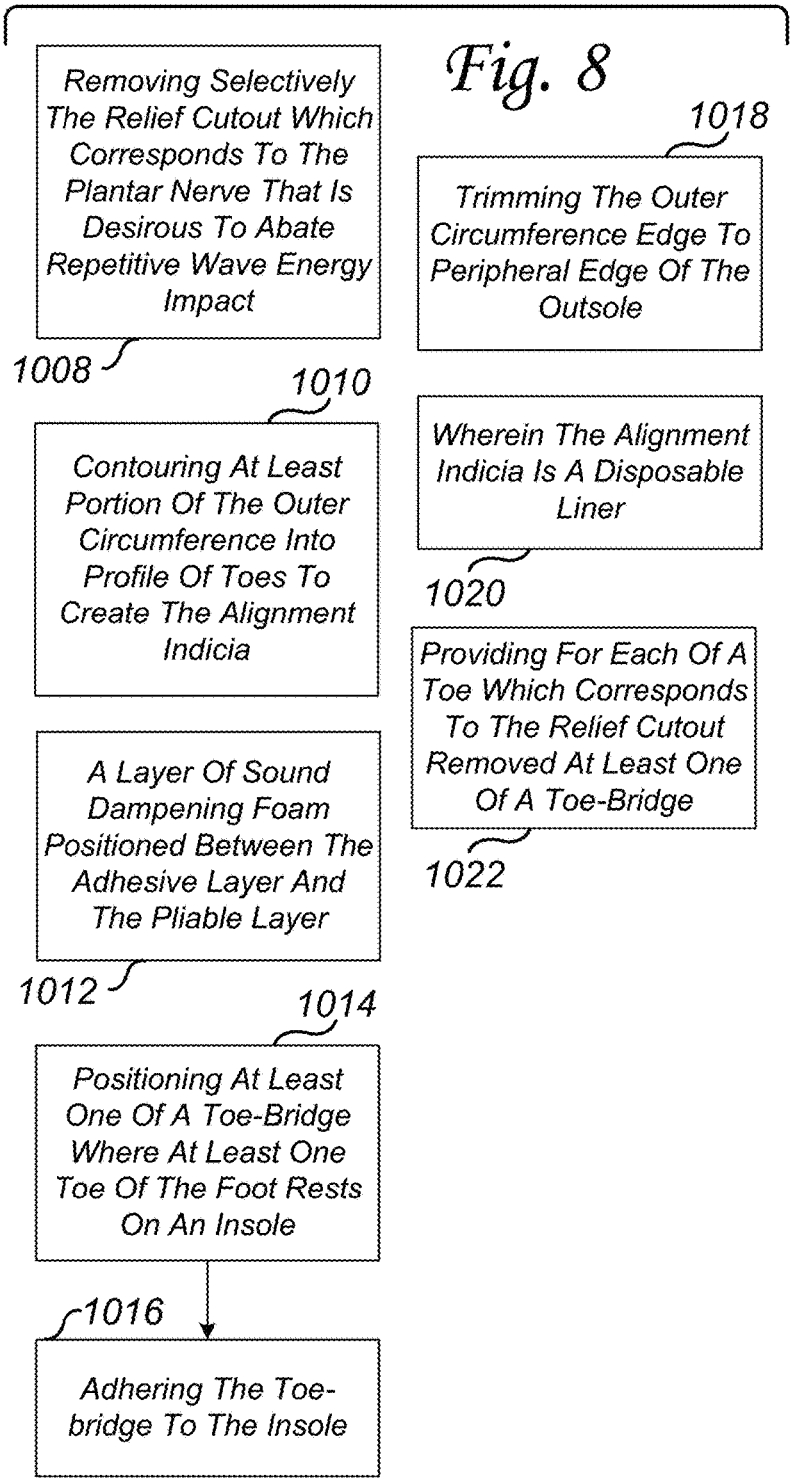
FIG. 8 illustrates exemplary embodiments of a method of minimizing foot pain from high heel, rigid, or thin sole shoes by abating trauma causing repetitive wave energy, generated by walking, from impacting certain of the plantar nerves located between the arch of foot and toes.

Referring to FIG. 8 there is illustrated exemplary embodiments of a method of minimizing foot pain from high heel, rigid, or thin sole shoes by abating trauma causing repetitive wave energy, generated by walking, from impacting certain of the plantar nerves located between the arch of foot and toes. Such exemplary embodiments can be interchangeably used with the methods of the present invention.

In block 1008, selectively, the relief cut which corresponds to the plantar nerve that is desirous to abate adverse repetitive wave energy impact can be removed. In this regard, creating the gap, by way of the pliable material 208, between the ground 110 and shoe 104 outsole 108.

In block 1010, at least a portion of the outer circumference edge is contoured into a profile of toes to create the alignment indicia. In an exemplary embodiment, this makes it easy for a consumer to align the retrofit plantar nerve protecting shoe sole 202 with their toes on foot 102 while in shoe 104.

In block 1012, a layer of sound damping material is positioned between the adhesive layer 210 and the pliable material 208. In an exemplary embodiment, such sound damping material offers superior energy wave 112 dampening properties which aid in minimizing trauma to plantar nerves and thus foot pain.

In block 1014, at least one of a toe-bridge 216 is positioned where at least one toe 306A-306F of the foot 104 rests on the insole 106, effectuating the raising of at least one toe of the foot off of the insole 106. The method moves to block 1016.

In block 1016, the toe-bridge 216 is adhered to the insole 106, securing it into position.

In block 1018, the outer circumference edge 218 is trimmed to the peripheral edge of the outsole 108. In an exemplary embodiment, excess retrofit plantar nerve protecting shoe sole 202 that extends beyond the outsole 108 can be trimmed off making a perfect sized fit on outsole 108. Scissors 110 or other cutting means can be used to trim the retrofit plantar nerve protecting shoe sole 202.

In block 1020, the alignment indicia 204 is a disposable liner 212 which can be removed and discarded at the time of installation of the retrofit plantar nerve protecting shoe sole 202 onto the shoe 104 outsole 108.

In block 1022, for each of a toe which corresponds to the relief cutout removed at least one of a toe-bridge is provided, the toe-bridge is to be positioned and adhered into places where the toe of the foot rests on the insole 106, effectuating raising the toe off of the insole 106.

The capabilities of the present invention can be implemented in software, firmware, hardware or some combination thereof.

As one example, one or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine, tangibly embodying at least one program of instructions executable by the machine to perform the capabilities of the present invention can be provided.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A retrofit plantar nerve protecting shoe sole attaches to the ground contacting surface of a shoe outsole, the retrofit plantar nerve protecting shoe sole minimizes foot pain from high heel, rigid, or thin sole shoes by abating trauma causing repetitive wave energy, generated when shoe makes contact with ground, such as when walking, from impacting certain plantar nerves located between arch of foot and toes, the retrofit plantar nerve protecting shoe sole comprising:

a shoe outsole having a ground contacting surface;

at least one of a pliable material comprising an outer circumference edge and at least one of a relief cutout, the relief cutout is either a recess or hole in portion of the pliable material;

at least one of an alignment indicia references projection of at least one toe, each of the relief cutout is positioned, sized, and orientated within the pliable material and with respect to the alignment indicia as to traverse along projected plantar nerve pathways; and at least one of an adhesive layer attaches the pliable material to the ground contacting surface of the shoe outsole, the pliable material, by way of the alignment indicia, is affixed in manner that preserves the orientation between the alignment indicia and projected location of toe in shoe so that each of the relief cutout is positioned around and below projected location of at least one plantar nerve of foot when foot is in shoe, the pliable material having a thickness proximate the outer circumference edge that elevates the shoe outsole when walking, while maintaining distribution of force across the shoe outsole, creating a gap within the relief cutout between the shoe outsole and ground, holding portion of the shoe outsole within the relief cutout from touching ground which minimizes introduction into the shoe outsole of trauma causing repetitive wave energy, and abating adverse impact on plantar nerves minimizing foot pain.

2. The retrofit plantar nerve protecting shoe sole in accordance with claim 1, at least portion of the outer circumference edge is contoured into profile of toes to create the alignment indicia.

3. The retrofit plantar nerve protecting shoe sole in accordance with claim 1, further comprising:

a layer of sound damping material positioned between the adhesive layer and the pliable material.

4. The retrofit plantar nerve protecting shoe sole in accordance with claim 1, at least portion of the pliable material is a shock absorbing material.

5. The retrofit plantar nerve protecting shoe sole in accordance with claim 1, further comprising:

at least one of a toe-bridge is configured to be positioned under middle and ring toe of foot when foot is in shoe, effectuating raising middle and ring toe of foot off of insole of shoe to reduce pressure on plantar nerves of foot, the toe-bridge is adhered to insole of shoe.

6. The retrofit plantar nerve protecting shoe sole in accordance with claim 1, further comprising:

a disposable liner having the alignment indicia disposed thereon.

7. A retrofit plantar nerve protecting shoe sole attaches to the ground contacting surface of a shoe outsole, the retrofit plantar nerve protecting shoe sole minimizes foot pain from high heel, rigid, or thin sole shoes by abating trauma causing repetitive wave energy, generated when shoe makes contact with ground, such as when walking, from impacting certain plantar nerves located between arch of foot and toes, the retrofit plantar nerve protecting shoe sole comprising:

a shoe outsole having a ground contacting surface;

at least one of a pliable material comprising an outer circumference edge and at least one of a relief cutout, each of the relief cutout is cut but remains connected in place optionally removable at time of installation;

at least one of an alignment indicia references projection of at least one toe, each of the relief cutout is positioned, sized, and orientated within the pliable material and with respect to the alignment indicia as to traverse along projected plantar nerve pathways;

at least one of an adhesive layer attaches the pliable material to the ground contacting surface of the shoe outsole, the pliable material, by way of the alignment indicia, is affixed in manner that preserves orientation between the alignment indicia and projected location of toe in shoe so that each of the relief cutout is positioned around and below projected location of at least one plantar nerve of foot when foot is in shoe, the pliable material having a thickness proximate the outer circumference edge that elevates the shoe outsole when walking, while maintaining distribution of force across the shoe outsole, creating a gap within each of the relief cutout between the shoe outsole and ground, holding portion of the shoe outsole within each of the relief cutout from touching ground which minimizes introduction into the shoe outsole of trauma causing repetitive wave energy, and abating adverse impact on plantar nerves minimizing foot pain.

8. The retrofit plantar nerve protecting shoe sole in accordance with claim 7, at least portion of the outer circumference edge is contoured into profile of toes to create the alignment indicia.

9. The retrofit plantar nerve protecting shoe sole in accordance with claim 7, further comprising:

a layer of sound damping material positioned between the adhesive layer and the pliable material.

10. The retrofit plantar nerve protecting shoe sole in accordance with claim 7, at least portion of the pliable material is a shock absorbing material.

11. The retrofit plantar nerve protecting shoe sole in accordance with claim 7, further comprising:

at least one of a toe-bridge is configured to be positioned under toes of foot when foot is in shoe, effectuating raising of at least one toe of foot off of insole of shoe to reduce pressure on plantar nerves of foot, the toe-bridge is adhered to insole of shoe.

12. The retrofit plantar nerve protecting shoe sole in accordance with claim 7, further comprising:

a disposable liner having the alignment indicia disposed thereon.

13. A method of minimizing foot pain from high heel, rigid, or thin sole shoes by abating trauma causing repetitive wave energy, generated when shoe makes contact with ground, such as when walking, from impacting certain plantar nerves located between arch of foot and toes, the method comprising the steps of:

forming a retrofit plantar nerve protecting shoe sole from at least one of a pliable material, the pliable material having an outer circumference edge and at least one of a relief cutout, the retrofit plantar nerve protecting shoe sole further comprising at least one of an alignment indicia that references projection of at least one toe, and at least one of an adhesive layer, each of the relief cutout is cut and selectively removable creating either a recess or hole in portion of the retrofit plantar nerve protecting shoe sole, each of the relief cutout is positioned, sized, and orientated within the pliable material and with respect to the alignment indicia as to traverse along projected plantar nerve pathways;

orientating the retrofit plantar nerve protecting shoe sole on a shoe outsole having a ground contacting surface, by way of the alignment indicia, below projected location of foot in shoe; and adhering, by way of the adhesive layer, the retrofit plantar nerve protecting shoe sole to the ground contacting surface of the shoe outsole in manner that preserves orientation between the alignment indicia and projected location of foot in shoe so that each of the relief cutout is positioned around and below projected location of at least one plantar nerve of foot when foot is in shoe, the pliable material having a thickness proximate the circumference edge that elevates the shoe outsole when walking, while maintaining distribution of force across the shoe outsole, creating a gap within the relief cutout between the shoe outsole and ground, holding portion of the shoe outsole within the relief cutout from touching ground which minimizes introduction into the shoe outsole of trauma causing repetitive wave energy, and abating adverse impact on plantar nerves minimizing foot pain.

14. The method in accordance with claim 13, further comprising:

removing, selectively, the relief cutout which is configured to correspond to at least one plantar nerve of foot that is desirous to abate adverse repetitive wave energy impact.

15. The method in accordance with claim 13, further comprising:

contouring at least portion of the outer circumference edge into profile of toes to create the alignment indicia.

16. The method in accordance with claim 13, further comprising:

adding a layer of sound damping material positioned between the adhesive layer and the pliable material.

17. The method in accordance with claim 13, further comprising:

forming at least portion of the pliable material from a shock absorbing material.

18. The method in accordance with claim 13, further comprising:

positioning, selectively, at least one of a toe-bridge the toe-bridge is configured to be positioned under at least one toe of foot when foot is in shoe, effectuating raising toe off of insole of shoe to reduce pressure on plantar nerves of foot; and adhering the toe-bridge to insole of shoe.

19. The method in accordance with claim 13, further comprising:

forming a toe-bridge, within the relief cutout material region, the toe-bridge is detachable and configured to be positioned under at least one toe of foot when foot is in shoe, effectuating raising toe off of insole of shoe to reduce pressure on plantar nerves of foot.

20. The method in accordance with claim 13, wherein the alignment indicia is printed on a disposable liner.

* * * * *